United States Patent [19]

Imamura et al.

[11] 4,190,549

[45] Feb. 26, 1980

[54] SOAP FOR SCOURING PAD

[75] Inventors: Tetsuya Imamura; Takashi Hiraide, both of Tokyo, Japan

[73] Assignee: Kao Soap Co., Ltd., Tokyo, Japan

[21] Appl. No.: 961,214

[22] Filed: Nov. 16, 1978

[30] Foreign Application Priority Data

Dec. 26, 1977 [JP] Japan ..... 52/156948

[51] Int. Cl.[2] ..... A47L 17/08; C11D 9/02; C11D 17/04

[52] U.S. Cl. ..... 252/91; 15/104.93; 252/108; 252/132; 252/134; 252/367; 252/368; 252/DIG. 16

[58] Field of Search ..... 15/104.93; 252/91, 92, 252/108, 132, 134, 367, 368

[56] References Cited

U.S. PATENT DOCUMENTS

| | | | |
|---|---|---|---|
| 2,432,091 | 12/1947 | Englund | 252/91 X |
| 3,337,465 | 8/1967 | Lancz | 252/91 X |
| 3,338,742 | 8/1967 | Swain | 252/91 X |
| 3,494,869 | 2/1970 | Armstrong | 252/109 |
| 3,511,783 | 5/1970 | Waring | 252/132 X |
| 3,576,749 | 4/1971 | Megson | 252/132 |
| 3,585,144 | 6/1971 | Schiltz | 252/91 |
| 3,598,746 | 8/1971 | Kaniecki | 252/122 |
| 3,725,288 | 4/1973 | Bechtold | 252/91 |
| 3,991,001 | 11/1976 | Srinivasan | 252/132 X |

*Primary Examiner*—Dennis L. Albrecht
*Attorney, Agent, or Firm*—Blanchard, Flynn, Thiel, Boutell & Tanis

[57] ABSTRACT

A soap for a scouring pad comprising a partially neutralized alkali metal salt of a fatty acid, said fatty acid having an average carbon atom number of 16 to 20 and an iodine value of 30 to 45, the degree of neutralization of the fatty acid with the alkali metal being from 85 to 98% by weight.

5 Claims, No Drawings

SOAP FOR SCOURING PAD

BACKGROUND OF THE INVENTION

1. Field of the Invention

The present invention relates to a soap for scouring pads.

2. Description of the Prior Art

Soils and stains adhering to pots and frying pans, scorching stains, roasting stains, soils and stains adhering to gas ranges, sticky oily soils adhering to fans and stains in the joints of tiles are observed in houses and these soils and stains are very difficult to remove. For removing these soils and stains, there have heretofore been used detergents including an alkali and a solvent, ammonia, caustic soda, abrasive cleaners, nylon cleaning pads, steel wool, metal brushes, spatulas and knives. When detergents and the like having a chemical action are used, a considerable soil and stain removing effect can be attained for soils and stains formed by modification and polymerization of oils by heat, light or air, but soils and stains formed by scorching and carbonization of boiled soups or oils are scarcely removed. By the physical action of nylon cleaning pads, steel wool, metal brushes and other mechanical polishing materials, pots, frying pans, tiles and plastics are abraded simultaneously with the removal of the soils and stains. Accordingly, the surfaces of the articles are readily scratched whereby to degrade the surface appearance thereof. Such articles are readily soiled and contaminated again because of the existence of scratches and the like.

Various soap-filled steel wools (hereinafter referred to as "scouring pads") have been developed as means for eliminating the foregoing disadvantages.

As the soap to be applied to such scouring pads, there are known the potassium salt of coconut fatty acid, the sodium salt of beef-tallow fatty acid and the like. However, those soaps are not fully satisfactory because they do not prevent the formation of scratches on the surface of an article that is polished and rust is readily formed during the preparation of the scouring pads or while the scouring pads are actually used for polishing.

As a result of research made with a view to eliminating those defects of known scouring pads, we have found, to our surprise, that if a soap having a specific composition is used as the soap ingredient of a scouring pad, these disadvantages can be eliminated.

SUMMARY OF THE INVENTION

More specifically, in accordance with the present invention, there is provided a soap for scouring pads comprising a partially neutralized salt of a fatty acid with an alkali metal, said fatty acid having an average carbon atom number of 16 to 20 and an iodine value of 30 to 45 and the degree of neutralization of the fatty acid with the alkali metal is from 85 to 98% by weight.

It was found that the formation of scratches on the surface of an article that is cleaned and polished is greatly influenced by the steel fibers, the so-called steel wool, constituting the scouring pad, but when the same steel fibers are employed, the scratching degree is remarkably influenced by the degree of neutralization of the soap used, that is, the weight ratio (% by weight; hereinafter referred to merely as "%") of the amount of the alkali used for neutralization of the fatty acid to the theoretical amount of the alkali necessary for complete neutralization of the fatty acid, which is calculated from the neutralization value of the fatty acid. It was also found that although the formation of rust during use can be reduced by reducing the solubility of the soap, the formation of rust during the manufacturing process is greatly influenced by the iodine value of the starting fatty acid of the soap, namely, the amount of water retained in the soap. Based on these findings, we have discovered a soap for a scouring pad, which has the above-mentioned specific composition.

The soap of the present invention is prepared by mixing a partially hydrogenated fatty acid or a double bond-containing fatty acid with a saturated fatty acid to adjust the average carbon atom number of the resulting fatty acid mixture to 16 to 20, preferably 17 to 19, and also adjusting the iodine value of the fatty acid mixture to 30 to 45, preferably 35 to 43, and then partially neutralizing the fatty acid mixture with an alkali metal so that the degree of neutralization is from 85 to 98%, preferably 90 to 96%. When the thus-prepared soap is used in a scouring pad, there is obtained a scouring pad which scarcely scratches the surface of the article that is cleaned and polished and in which the formation of rust is prevented during the manufacturing process and during use.

As a soap known for use in a scouring pad. there can be mentioned an alkali metal salt of lauric acid or animal-tallow (beef-tallow) fatty acid as disclosed in U.S. Pat. No. 3,337,465, a sodium salt of animal-tallow (beef-tallow) fatty acid as disclosed in U.S. Pat. No. 3,725,288, and a sodium salt of coconut fatty acid or beef-tallow fatty acid as disclosed in Japanese Patent Application No. 20112/77. These known fatty acid salts, except the animal-tallow (beef-tallow) fatty acid salts, fail to satisfy the requirement of the average carbon atom number of the fatty acid specified in the present invention. The customarily used animal-tallow fatty acid is generally beef-tallow fatty acid. The Official American Fats and Oils Association Export Grades teaches that, in general, industrially utilizable beef-tallow fatty acid has a titer of 36° to 42° C., which corresponds to an iodine value higher than 46, although the value differs to some extent depending on the part of the animal from which the beef tallow has been collected. Accordingly, the beef-tallow fatty acid customarily used for industrial and commercial purposes has an iodine value exceeding 45, and in this point, the soap of the present invention is distinguishable from the conventional beef-tallow soap.

Adjustment of the iodine value can be accomplished in the present invention by mixing a saturated fatty acid and an unsaturated fatty acid. However, from the industrial viewpoint, it is preferred to use, as the fatty acid, partially hydrogenated beef-tallow fatty acid obtained by reacting ordinary beef-tallow fatty acid with hydrogen in the presence of a catalyst. This partially hydrogenated beef-tallow fatty acid can be prepared by a customary industrial scale method. For example, there can be adopted a method in which beef-tallow fatty acid having an iodine value of 48 is hydrogenated for 1 hour at a temperature of 150° C. and a hydrogen pressure of 4.0 $Kg/cm^2$, in the presence of 0.05% of a nickel catalyst, whereby the iodine value is reduced to 45.

From the viewpoint of the water solubility, an alkali metal is used as the counter ion of the soap, and a sodium salt or a mixture of sodium and potassium salts is preferably employed. It is preferred that the weight ratio of sodium:potassium is in the range of from 100:0 to 90:10.

In the manufacturing of a scouring pad, a non-soap synthetic organic surface active agent, an inorganic salt and the like can be incorporated in the scouring pad, in combination with the soap of the present invention.

It is preferred that the soap of the present invention is present in an amount of at least 60% based on the total surfactant components, although the amount of the soap is not particularly critical.

As the non-soap synthetic organic surface active agent, there can be used anionic surface active agents, nonionic surface active agents and amphoteric surface active agents. As the anionic surface active agent, there can be mentioned alkyl sulfates having 10 to 22 carbon atoms, alkylbenzenesulfonates having 8 to 16 carbon atoms in the alkyl group, polyoxyethylene alkylether sulfates having 10 to 20 carbon atoms in the alkyl group and containing 1 to 10 moles of added ethylene oxide, polyoxyethylene alkylphenol sulfates having 8 to 12 carbon atoms in the alkyl group and containing 1 to 10 moles of added ethylene oxide, $\alpha$-olefin sulfonates obtained by sulfonation of $\alpha$-olefins having 10 to 18 carbon atoms, and alkane-sulfonates derived from paraffins having 10 to 20 carbon atoms. As the nonionic surface active agent, there can be mentioned polyoxyethylene alkyl ethers formed by adding 1 to 20 moles of ethylene oxide to higher alcohols having 10 to 20 carbon atoms, polyoxyethylene alkylphenyl ethers formed by adding 1 to 20 moles of ethylene oxide to alkylphenols having 8 to 12 carbon atoms in the alkyl group, glycerin esters of fatty acids having 10 to 20 carbon atoms, and fatty acid alkanolamides derived from fatty acids having 10 to 20 carbon atoms and alkanolamines such as diethanolamine and diisopropanolamine. As the amphoteric surface active agent, there can be mentioned alkyl betaines, alkyl sulfobetaines, imidazole derivatives and alkyl alanines.

As the water-soluble inorganic salt, there can be used sulfates such as sodium sulfate and potassium sulfate, carbonates such as sodium carbonate and potassium carbonate, silicates such as sodium metasilicate and sodium silicate No. 2, borates such as borax and sodium metaborate, and phosphates such as sodium orthophosphate, sodium tripolyphosphate and sodium pyrophosphate.

In addition, coloring agents, perfumes, fungicides, antiseptics and rust-preventing agents can be incorporated according to need.

When the diameter of the metal wires constituting the scouring pad is too large, the article to be cleaned and polished is readily scratched and the touch to the hand is not good. When the diameter is too small, the polishing power is degraded. Accordingly, wires having an average diameter of 1 to 500$\mu$, preferably 10 to 70 $\mu$, are used. The cross-sectional shape of the wires is not particularly critical, and wires having any of triangular, square, circular and flat cross-sectional shapes can be used in the present invention. The material of which the wires is made is not particularly critical. However, in general, there are used metals having a tensile strength sufficient to be formed into metal wires, such as plain carbon steels, stainless steel and brass. From the viewpoints of the polishing power and the touch to the hand, plain carbon steels are especially preferred. The overall configuration of the pad defined by the metal wires can be square, rectangular, elliptical (each having a substantial thickness) or spherical.

In general, a scouring pad is prepared by arranging the metal wires to have an appropriate shape, sprinkling an aqueous solution containing the detergent components on the wire assembly and heating the wire assembly under compression to remove the water. Of course, other methods can be adopted for production of scouring pads.

The present invention will now be described in detail by reference to the following illustrative Examples. The Examples do not limit the scope of the invention.

EXAMPLE 1

Coconut fatty acid (having an average carbon number of 12.6 and an iodine value of 8) and partially hydrogenated beef-tallow fatty acid (having an average carbon number of 17.4 and an iodine value of 45) were mixed together at various mixing ratios. By using these mixtures, scouring pads were prepared according to the method described hereinafter. Then, with respect to each scouring pad, the useful life and scratching property were examined according to the methods described hereinafter. The results obtained are set forth in Table 1.

Method of Preparation of Scouring Pads.

5 g of steel wires having an average diameter of 20 to 50$\mu$were formed into a disc-shape pad having a diameter of 5 cm and a thickness of 1.5 cm, and 20 g of a 20% by weight aqueous solution of a sodium soap of a mixed fatty acid formed by neutralizing the predetermined mixed fatty acid to a neutralization degree of 95% by means of sodium hydroxide was applied to the disc-shaped pad of 70° C. Then, the pad was heated under compression to press the adhering soap into the interior of the pad and to evaporate the water, whereby a scouring pad was obtained.

Life of Scouring Pad

A paint was coated in a layer having a thickness of 1 mm onto an aluminum saucer having a diameter of 7 cm and then the paint was dried. Then, the saucer was filled with 5 ml of water, and the scouring pad was pressed against the saucer under a load of 2 Kg and was rotated at 300 rpm for 5 minutes by a laboratory motor whereby to polish the saucer, following which the saucer was washed by water. This polishing operation was conducted 3 times, and the state of formation of rust on the scouring pad was examined with the naked eye and the useful life was evaluated according to the following scale:

○ : no rust was formed
Δ : slight formation of rust was observed
X : A large amount of rust was formed

Scratching Property

An aluminum saucer having a diameter of 7 cm was filled with 5 ml of water, and the scouring pad was pressed against the saucer under a load of 2 Kg and was rotated at 300 rpm for 2 minutes by a laboratory motor to polish the saucer. The scratching index was determined by measuring the difference between the weight of the saucer before the polishing and the weight of the saucer after the polishing, according to the following formula:

$$\text{Scratching index} = \frac{(W_1 - W_2)}{(W_1' - W_2')} \times 100$$

$W_1$ is weight of saucer before polishing $W_2$ is weight of saucer after polishing
$W'_1$ is weight of steel wire before polishing
$W'_2$ is weight of steel wire after polishing Note:
In the above definitions for $W'_1$ and $W'_2$, "steel wire" means the disc-shaped pad free of soap.

Table 1

| | | | | | |
|---|---|---|---|---|---|
| coconut fatty acid/partially hydrogenated beef-tallow fatty acid ratio | 100/0 | 75/25 | 50/50 | 25/75 | 0/100 |
| average carbon number | 12.6 | 13.8 | 15.0 | 16.2 | 17.4 |
| iodine value | 8 | 17.3 | 26.5 | 35.8 | 45 |
| life of scouring pad | X | X | O | O | O |
| scratching property (scratching index) | 15 | 14 | 12 | 5 | 5 |

From the results shown in Table 1, it will be understood that the fatty acids having an average carbon number of from 16 to 20 and an iodine value of 30 to 45, in which the coconut fatty acid/partially hydrogenated beef-tallow fatty acid ration is b 25/75 or 0/100, provide good scouring pads having a long useful life and a much reduced scratching property.

EXAMPLE 2

Beef-tallow fatty acid was hydrogenated according to the method described hereinabove, and scouring pads were prepared in the same manner as described in Example 1. The formation of rust during the preparation process, especially at the drying step, the smell of the scouring pad and falling out of the applied soap from the pad were determined. The results obtained are shown in Table 2.

Table 2

| | Iodine Value | | | | | |
|---|---|---|---|---|---|---|
| Test Item | 48 | 45 | 40 | 31 | 23 | 10 |
| formation of rust | none | none | none | none | observed | observed |
| smell of scouring pad | bad smell | good | good | good | good | good |
| falling out of applied soap from the pad | A | A | A | A | B | B |

Note:
Formation of Rust: Formation of rust at the drying step conducted after pressing of the soap into the pad during the scouring pad-preparing process was examined with the naked eye.
Smell of Scouring Pad: The smell of the scouring pad was examined according to the organoleptic test.
Falling Out of Applied Soap: Five dried scouring pads were placed in a cardboard box having a size of 6 cm×10 cm×15 cm, and the box was shaken for 10 minutes at an amplitude of 20 cm. The falling out of the applied soap was evaluated based on the amount of the soap that fell out, according to the following scale:
A: falling out was scarcely observed
B: falling out was conspicuous From the results shown in Table 2, it will be understood that when the iodine value is lower than 30, rust is readily formed and applied soap tends to fall out from the pad, and if the iodine value exceeds 45, the pad could not be practically used because of bad smell.

EXAMPLE 3

In the same manner as described in Example 1, scouring pads were prepared by using soaps differing in the degree of neutralization, and the influences of the degree of neutralization were examined. The results obtained are shown in Table 3.

Table 3

| | Degree of Neutralization (%) | | | | | | |
|---|---|---|---|---|---|---|---|
| | 80 | 85 | 90 | 95 | 98 | 100 | 110 |
| scratching property (scratching index) | 3 | 3 | 5 | 5 | 5 | 11 | 20 |
| polishing property (polishing index) | 130 | 170 | 175 | 180 | 180 | 180 | 180 |

Note
Degree of Neutralization: Partially hydrogenated beef-tallow fatty acid having a neutralization value of 205 was treated with sodium hydroxide so that a predetermined degree of neutralization was attained.
Scratching Property: The scratching property was evaluated according to the method described in Example 1.
Polishing Property: A layer of paint was coated in a thickness of 1 mm on an aluminum saucer having a diameter of 7 cm and then dried. According to the same method was described in Example 1 with respect to the determination of the scratching property, the saucer was polished, and the polishing index was calculated according to the following formula:

$$\text{Polishing index} = \frac{(C_1 - C_2)}{(C_1' - C_2')} \times 100$$

$C_1$ is weight of saucer before polishing
$C_2$ is weight of saucer after polishing
$C'_1$ is weight of steel wire before polishing
$C'_2$ is weight of steel wire after polishing From the results shown in Table 3, it will readily be understood that when free alkali is contained in the soap or the soap is completely neutralized, the surface of the polished article is extremely scratched and such soap is not suitable for the purposes of the invention. From the viewpoint of the polishing property, the lower limit of the degree of neutralization is set at 85%.

EXAMPLE 4

The soap of the present invention was mixed with other components and applied to steel wool pad to form a scouring pad. The properties of this scouring pad were compared with those of a commercially available scouring pad. The results obtained are shown in Table 4.

Table 4

| Item | Present Invention* | Commercial Product |
|---|---|---|
| life of scouring pad | O | X |

Table 4-continued

| | | |
|---|---|---|
| scratching property (scratching index) | 0 | 11 |
| formation of rust | not observed | observed |
| smell of scouring pad | good | bad (smell of fatty acid) |
| falling out of applied soap | A | B |
| polishing property (polishing index) | 180 | 155 |

*By using 5 g of a mixture having the following composition, a scouring pad was prepared according to the method described in Example 1.

| | |
|---|---|
| Salt of partially hydrogenated beef-tallow fatty acid (degree of neutralization = 95%, Na/K weight ratio = 9/1, iodine value = 40) | 90% by weight |
| Sodium linear alkyl ($\bar{C}$ = 12) benzenesulfonate | 5% by weight |
| Sodium silicate ($Na_2O/SiO_2$ = 1/2.5) | 5% by weight |

The embodiments of the invention in which an exclusive property or privilege is claimed are defined as follows:

1. A soap-filled steel wool scouring pad in which the soap consists essentially of neutralized alkali metal salt of fatty acid, said fatty acid having an average carbon number of 16 to 20 and an iodine value of 30 to 45, the degree of neutralization of said fatty acid with the alkali metal being from 85 to 98% by weight.

2. A scouring pad according to claim 1 wherein the iodine value of said fatty acid is 35 to 43.

3. A scouring pad according to claim 1 or claim 2 wherein the degree of neutralization of said fatty acid is 90 to 96% by weight.

4. A scouring pad according to claim 1 wherein said fatty acid is partially hydrogenated beef-tallow fatty acid.

5. A scouring pad according to claim 1 or claim 4 wherein said partially neutralized alkali metal salt of said fatty acid is a salt with sodium or sodium and potassium, and the weight ratio of sodium:potassium is in the range of from 100:0 to 90:10.

* * * * *